United States Patent [19]

Whines

[11] Patent Number: 4,748,924

[45] Date of Patent: Jun. 7, 1988

[54] HOSIERY TRANSPORT

[75] Inventor: Simon A. Whines, Marlow, England

[73] Assignee: Detexomat Machinery Ltd., England

[21] Appl. No.: 935,043

[22] Filed: Nov. 26, 1986

[30] Foreign Application Priority Data

Nov. 26, 1985 [GB] United Kingdom ..... 8529126
Dec. 16, 1985 [GB] United Kingdom ..... 8530939

[51] Int. Cl.[4] ..... D05B 33/00
[52] U.S. Cl. ..... 112/121.15; 223/43
[58] Field of Search ..... 112/121.15, 121.12, 112/121.11; 223/41, 43, 39, 112

[56] References Cited

U.S. PATENT DOCUMENTS 4,192,242 3/1980 Haselgrove et al. ..... 112/121.15 X
4,303,026 12/1981 Ueda ..... 112/121.15
4,383,490 5/1983 Hodges ..... 112/121.15
4,444,140 4/1984 Meyer ..... 112/121.15 X
4,598,656 7/1986 Calamani et al. ..... 112/121.12
4,620,494 11/1986 Takatori et al. ..... 223/43 X
4,628,844 12/1986 Hodges ..... 112/121.15
4,649,838 3/1987 Gazzarrini ..... 112/121.15
4,664,044 5/1987 Gazzarrini ..... 112/121.15

FOREIGN PATENT DOCUMENTS 126800 12/1984 European Pat. Off. .

*Primary Examiner*—H. Hampton Hunter
*Attorney, Agent, or Firm*—Dority & Manning

[57] ABSTRACT

Hose transport apparatus for instance incorporated in a line closer consists of a plurality of carriers movable around an endless path and stationary rails extending alongside the path to support hose partly by the carriers and partly by the rails. The parts of hose supported by the rails are pushed along them by a push rod which moves closely beside the rails, the rod being affixed to the associated carrier to move at the speed of the latter and thereby ensure that the moving hose draped over the rails do not slip therefrom due to frictional drag.

18 Claims, 4 Drawing Sheets

HOSIERY TRANSPORT

The present invention concerns improvements related to hosiery transport and primarily, but not exclusively, to improvements in line closers.

A line closer is used by hosiery manufacturers for joining the top ends of two previously knitted leg blanks to form the body part of a pantihose garment.

One such line closer has a carousel, rotating about a central vertical axis, which mounts a plurality of hose supports at spaced intervals thereabout. The supports advance hose around the line closer between a loading station, a seaming station and an unloading station. Beyond its periphery a guide rail or a pair thereof, encircles the carousel partly or entirely. Pairs of hose blanks loaded on each support have lower portions thereof draped-over the encircling rail or rails. The rail or rails may be required to keep the draped lower portions separated or to cause them to separate from one another as the carousel rotates. Separation of the lower portions may be important e.g. if the hose blanks, after line closing, are to be transferred automatically to another machine such as a toe closer. We have found, regrettably, the lower portions may sometimes slip off the guide rail(s). If that happens, the line closing operation may have to be stopped, with serious disruption to the production process, for the blanks to be restored to their previously draped condition. Further, if the blanks are to be automatically transferred to another machine, slippage from the rail(s) may render transfer impossible.

The supports each comprise a pair of arms operable to clamp and hold appropriately superimposed top ends of two hose blanks for line closing. When the support is loaded with its intended blanks, its arms are parallel and they extend generally radially with respect to the turning axis of the carousel. Subsequently, the radially inner or proximal ends of the arms are swung apart, (the arms effectively pivoting adjacent their outer or distal ends), to open the hose blanks at their top ends. Line closing is performed with the arms in this position. We find that the lower portion of one or both blanks held by the arms may slip off the rail or rails at any time, especially where the blanks are short, for example when the arms are swung apart. Slippage would be particularly likely where the blanks are transported around a stationary guide rail, due to drag or friction between them and the rail. Even if the rail were made to rotate with the carousel, the risk of the blanks falling off the rail is ever present.

In some instances, the line closer has two stationary rails, one diverging from the other to separate the lower portions of the blanks as they are advanced while the carousel rotates. See our U.S. patent application Ser. No. 06/724,246, now U.S. Pat. No. 4,628,844 dated Dec. 16, 1986 and the equivalent No. EP-A-0174059, the disclosures of which are incorporated herein by this reference. We find slippage of at least one draped lower blank portion from its allotted rail can occur due to drag, e.g. where the rails diverge.

A broad object of this invention is to provide an improved garment e.g. hosiery transport apparatus, suitable inter alia for incorporating in a hosiery line closer.

The present invention aims for example, to prevent the lower portions of hose leg blanks from slipping off the guide rail(s) of a line closer, without unduly complicating the line closer.

This invention provides a solution to the problem of hose slipping from an elongated guide member over which part of the hose is draped.

According to the present invention there is provided apparatus for transporting a garment e.g. hosiery along a given path, comprising a carrier movable along the path and elongated support or guide member spaced from but extending alongside the path, the carrier and the elongated member serving as a garment support means, and garment displacing means movable adjacent the elongated member and in use operable positively to advance along the said member that part of the garment supported thereby, in unison and in substantial alignment with that part of the garment supported by the moving carrier.

The apparatus could be employed as a conveying installation in a garment-making factory, for conveying garments from one processing machine to another.

The garments can, for instance, be items of hosiery, i.e. individual socks or stockings, pantihose garments or pairs of hose legs for joining into pantihose.

The apparatus finds especial utility when embodied in a line closer; the advancing means is then identifiable as a hose carrier or support thereof and the elongated member is identifiable with the aforesaid rail or rails.

Conveniently, the garment displacing means is movable from an inactive to an active, garment-displacing position. The inactive position of the displacing means is such as to allow unobstructed access to the carrier, e.g. for mounting a garment thereon.

Also according to the present invention, there is provided a method of transporting a garment along a given path, comprising supporting the garment partly on a carrier movable along the path and partly on an elontated support member extending alongside the said path, advancing the carrier along the path, and positively displacing that part of the garment supported on the elongated member by a displacing means which travels adjacent the elongated member in unison with the carrier, so that the parts of the moving garment supported by the carrier and the elongated member remain in substantial alignment.

The invention further comprehends an improved method of line closing. Accordingly, there is provided a method of line closing hosiery to form pantihose garments using a line closer having carriers mounted on a carousel to move around an endless path from a loading station, through slitting and seaming stations and to a discharge station, wherein a pair of garment blanks is supported partly by a carrier and partly by an encircling support rail or rails disposed outwardly of the path swept by the moving carrier, and wherein those parts of the blanks supported on the rail or rails are positively displaced by a displacing means which travels adjacent the rail or rails in unison with the carrier during at least part of its movement around the endless path, so that the parts of the blanks supported by the carrier and the rail or rails remain in substantial alignment and those parts supported by the rail or rails are prevented from slipping inadvertently therefrom.

The invention will now be described in more detail, by way of example only, with reference to the accompanying drawings, in which.

Figure 1:
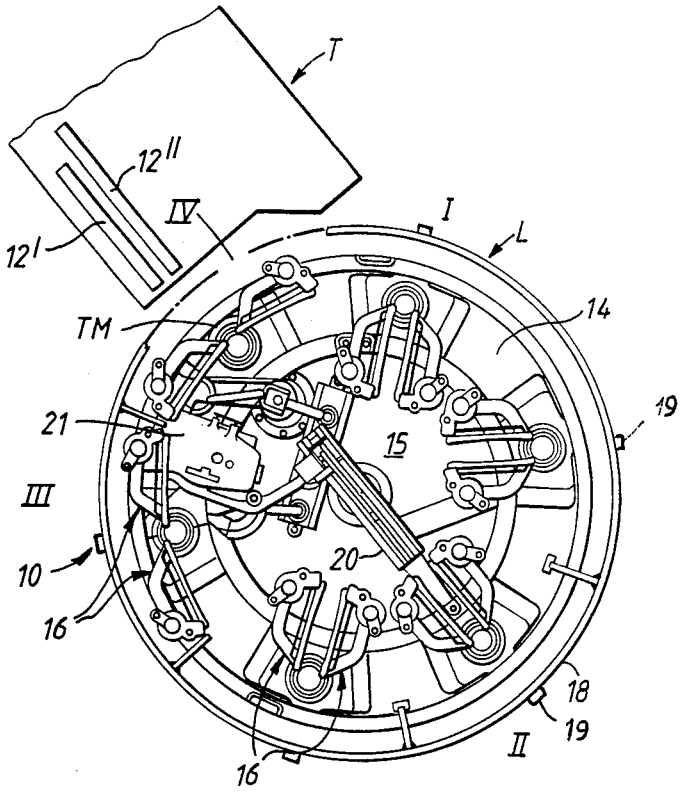
FIG. 1 is a plan view of a line closer embodying the invention, the line closer being operably associated with a toe closer.
Figure 4:
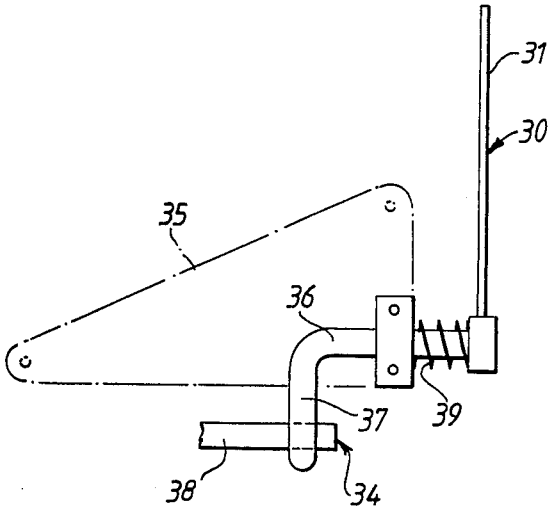
FIG. 4 shows in more detail a garment-displacing mechanism forming part of the apparatus of FIGS. 2 and 3.

The specific hosiery manufacturing equipment shown in FIG. 1 comprises a line closer L adapted according to the present invention to guard against the slippage problem noted hereinbefore. The line closer L is shown operably combined with another hosiery processing machine, in this example a toe closer T, and a transfer mechanism TM for conveying the hosiery items from one to the other, in this instance from the line closer L to the toe closer T. Although in the drawings the line closer L is associated with another hosiery processing machine, it need not be. The invention is not restricted to line closers, but for example can be embodied in other hosiery processing machines such as gusset-inserting machines, automatic hosiery loading apparatus for hosiery processing machines and in hosiery conveying systems for transporting hosiery about a manufacturing plant from one processing station to another.

Automatic loading apparatus, e.g. for a toe closer or boarding apparatus can comprise a turntable having hose-supporting projections (e.g. four) extending from its periphery, such projections in use moving with the turntable in sequence from a receiving position to a transfer or loading position. At the receiving position, welt ends of stockings or bodies of pantihose are placed on the projections, leaving the remainder of such hose dangling from the projections. At the transfer or loading position, a transfer mechanism takes hold of the hose part mounted on the projections, strips it from them, conveys it to carriers of the receiving machine and mounts it on said carriers. An elongated guide rail and garment displacing means as described hereafter can beneficially be used with such a loading apparatus to ensure that parts of the hose not mounted on the projections are conveyed properly to the transfer station for proper loading of the receiving machine such as a toe closer.

The line closer L and toe closer T will be familiar to the addressee and thus will not be described in full detail. The former can be a Takatori line closer Model No. LC-240, LC-280, LC-320 or LC-360. See for example U.S. Pat. No. 4,303,026 the disclosure of which is incorporated herein by this reference. The latter can be a Detexomat (RTM) SPEEDOMATIC (RTM) HS or PANTIMATIC (RTM) toe closer. See, for example, No. GB-B-1,501,869; No. GB-B-1,577,758; U.S. Pat. No. 4,192,242; No. GB-B-2,074,203 and U.S. Pat. No. 4,383,490, the disclosures of which are incorporated herein by this reference thereto. The transfer mechanism TM can, by way of example, include (a) endless conveying means which controllably deliver hose legs toe ends first to allotted leg tubes 12', 12" of the toe closer T, and (b) reciprocally-operable stripping/loading means that take hold of the waist-end of a line-closed garment on the line closer, strip it therefrom and load it upon the toe closer leg tubes 12', 12". Such a transfer mechanism is disclosed in No. EP-A-0174059 and its equivalent U.S. patent application Ser. No. 724,246.

Line closer L has a carousel 14 which rotates, usually stepwise, on a vertical axis about a stationary hub 15.

On the carousel are a plurality of hose blank carriers 16. The carriers are equispaced around the carousel 14 and move therewith to advance hose blanks around the line closer during the line closing operation.

An elongated support or guide rail member 18 encircles the carousel and rotates therewith. A cutting device 20 and sewing machine 21 are non-rotationally supported on the hub 15.

In use, two hose blanks are loaded on each carrier 16 arriving at a loading station for example indicated at I in FIG. 1. The hose blanks are disposed one above the other, their upper leg portions being supported on the carrier 16. Lower leg portions of the blanks are draped over and supported by the rail 18, one to either side of a protrusion 19 on the rail. The protrusion is to keep the lower portions separated during the line closing cycle. Instead of the single guide rail 18 and protrusions as illustrated in FIG. 1, the line closer can have two diverging guide rails 18', 18", see FIGS. 2 and 3, non-rotationally encircling the carousel 14. Each hose blank is draped over a respective rail and as the carousel rotates, the blanks are dynamically separated and kept separate by the two rails. See No. EP-A-0174059 and U.S. patent application Ser. No. 724,246.

As the carousel 14 rotates, each carrier 16 moves from station I to station II whereat a slit is made in each leg blank by cutting device 20. The carrier then moves to station III. Here, sewing machine 21 seams the slit edges together to form the body seam of a pantihose garment. From station III the carrier 16 moves to station IV and thence to station I again. At station IV, the partly-finished garments are stripped from the line closer L and loaded on the toe closer T by the transfer mechanism TM, as described above.

Each carrier 16 has two hose holding elements or arms 24 articulated to move between closed and open positions. In their closed positions the arms 24 are parallel and extend generally radially of the carousel 14 and hub 15. In their open positions, the arms are approximately tangentially arranged relative to the path of movement of the carrier 16. The arms are closed at loading and cutting stations I and II and open at seaming station III. Opening occurs between stations II and III. At, approaching or on leaving station IV, the arms may commence closing to assist the partly-finished garment to be slipped easily therefrom by transfer mechanism TM. Closing is either completed at station IV or subsequently as the supports approach the loading station I.

Figure 2:
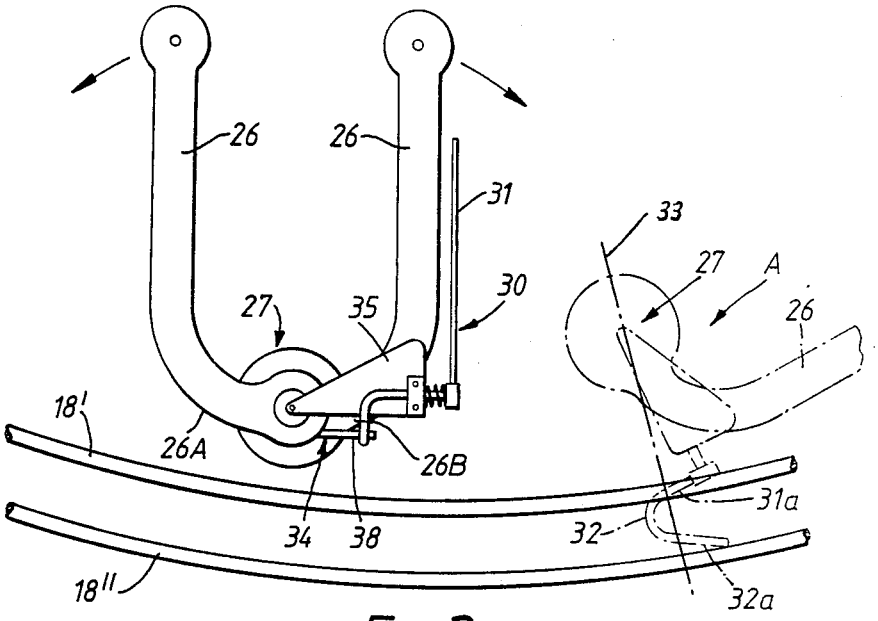
FIG. 2 is an enlarged plan view of apparatus according to the present invention.
Figure 3:
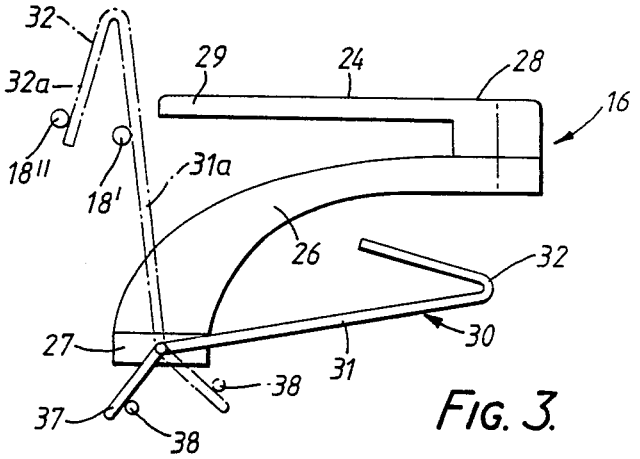
FIG. 3 is a side view of the apparatus shown in FIG. 2.
Figure 5:
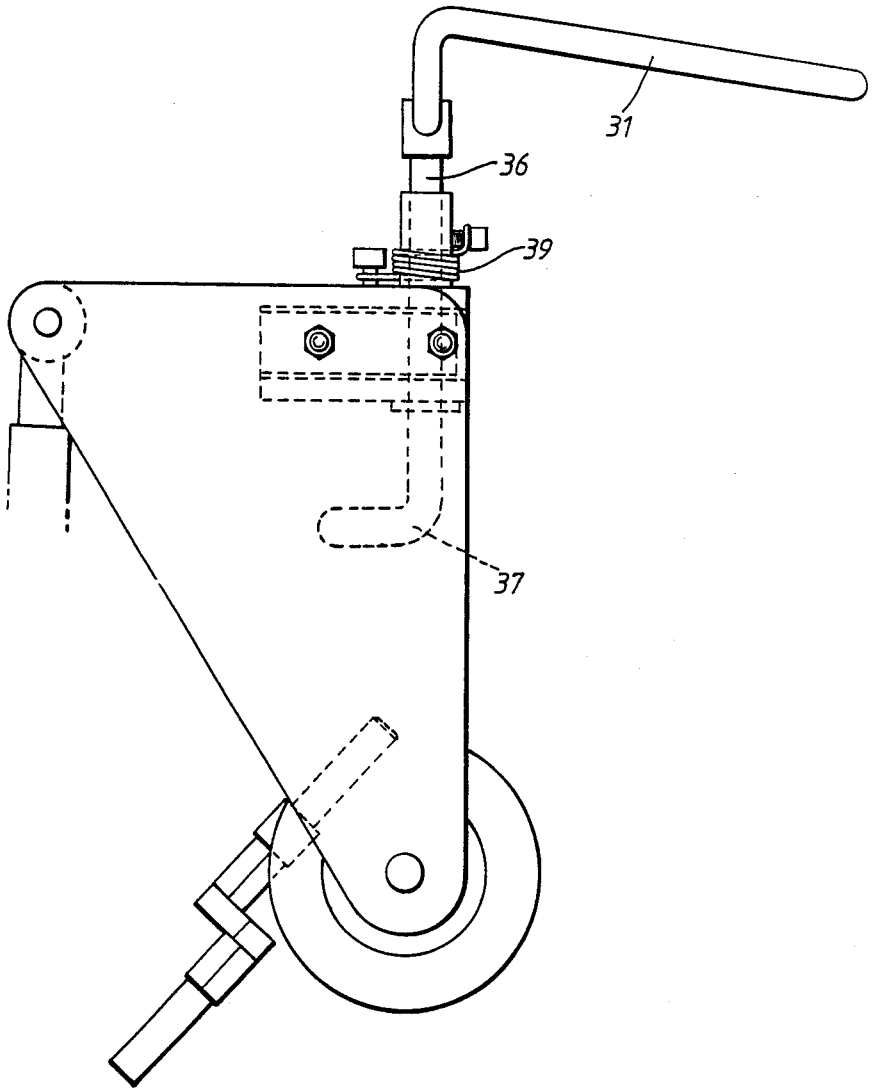
FIG. 5 is another detailed showing of the mechanism illustrated in FIG. 4.
Figure 6:
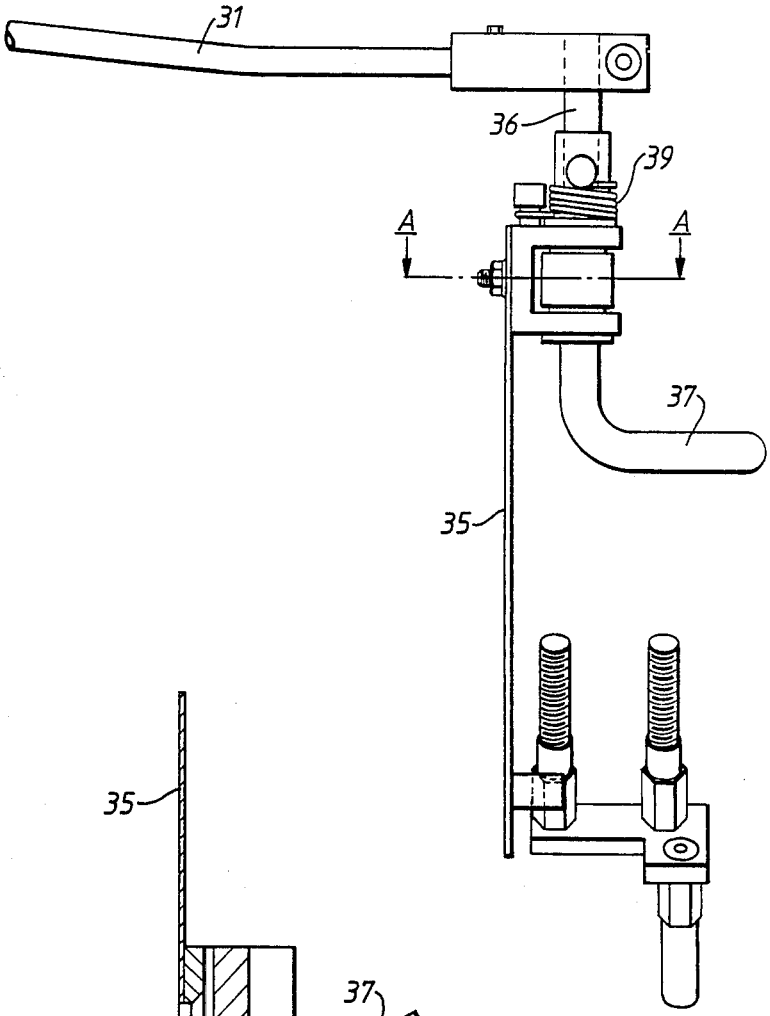
FIG. 6 is a detailed elevation of the mechanism shown in FIGS. 4 and 5.
Figure 7:
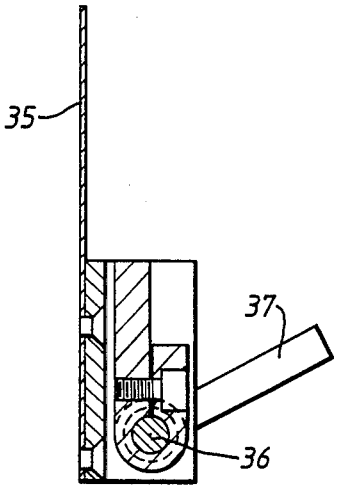
FIG. 7 is a section on the line A—A of FIG. 6.

As shown in FIGS. 2 and 3, the two arms 24 are cantilevered from respective brackets 26 secured to a mounting 27, e.g. a pivotal mounting, on the carousel 14. The arms are attached at their proximal ends 28 to their brackets 26. Their distal free ends 29 are disposed adjacent mounting 27, equidistant from it and one on each side thereof. Movement of the brackets 26 in mutually opposite directions on their mounting 27 articulates the arms 24 between their parallel, closed and spread, open positions. The arms 24 swing to and fro about their distal ends 29. Any convenient drive means can be employed to move the brackets 26, and can be incorporated in the mounting 27.

The arms 24 comprise upper and lower arm components which are relatively movable between open and clamping positions.

The carriers 16 as described above are known in the art and further discussion of them here is unnecessary. The precise manner in which they are loaded with hose blanks will be familiar to the addressee and hence will not be described here.

It will be recognised that the line closer L constitutes a hosiery or garment transport apparatus which conveys the hosiery along a path, which is circular, from loading station I to discharge station IV. The transport apparatus includes the carriers 16 and the rail 18 or rails 18', 18''. A pair of hose blanks for line closing is supported partly by one of the carriers 16 and partly by the rail or rails over which their lower leg portions are draped. This manner of supporting the hose blanks is not ideal, because portions of the hose blanks are unsupported between the arms 24 of the carrier 16 and the rail(s). At any time, these portions can slip off the rail(s), for example when the arms 24 are articulated between their closed and open positions. When the hose blanks slip from the rail(s) the line closing operation may have to be stopped, with consequent serious disruption in the manufacturing process, and the blanks must be restored to their previous draped condition. Short blanks may continually slip off the rail(s). Slippage is particularly likely when the rail or rails 18, 18', 18'' is or are stationary because drag causes the lower portions of the blanks to trail behind the moving carriers.

To overcome this problem, the transport apparatus comprising the carriers 16 and rail(s) 18, 18', 18'' is further provided with hosiery or garment displacing means 30 which are operable positively to advance the portions supported by the rail(s) therealong, in unison with and at a speed consistent with each moving carrier 16. The displacing means is operative thus while the arms 24 of each carrier 16 are in their open positions, i.e. when the carrier 16 is travelling from station II. If desired, the displacing means might be made operative earlier in the line closing cycle, i.e. before the carrier arrives at station II. The displacing means 30 are movable in conjunction with the carriers 16 and serve to keep the lower portions of the moving blanks in substantial alignment with their upper portions supported by the carriers 16.

A single displacing means 30 could be located e.g. between stations II and IV to coact with each carrier moving in turn between these stations. However, for simplicity there is a displacing means 30 for each carrier 16. Each displacing means 30 is mounted on part of its associated carrier 16 for simplicity, thus ensuring that they move together.

The displacing means 30 of the illustrated example is a hose pusher comprising a rod 31 which is pivotally mounted at one end for movement between an inactive and an active, garment-displacing position. In its inactive position, rod 31 is so disposed as to allow unobstructed access to the carrier 16 for mounting hose blanks thereon. As shown, the rod 31 is movable between a raised, garment-displacing position beside the rail(s) 18, 18', 18'' and a lowered, inactive position wherein it is spaced away from the rail(s) and the carrier 16. When lowered, the rod 31 is located below an arm 24 and associated bracket 26. The inactive position is maintained at least while the arms 24 of each carrier 16 are in their closed, parallel positions for loading and the active position is assumed at least while the arms are opened. In FIG. 2 the rod 31 is in its lowered, inactive position. In FIG. 3, the rod 31 is shown in both positions; the dotted position indicates the rod in its raised, active position.

When the rod 31 is raised, a cranked end portion 32 thereof projects above and moves closely alongside the rail(s) to push the blanks therealong. The cranked portion 32 is the form of choice where the line closer L has a pair of rails 18', 18''. Such a cranked formation could be omitted if the line closer has but a single rail. The displacing means 30 is so arranged that when raised, rod 31 has its end portion located radially outwardly of the mounting 27 for the arms, i.e. the end portion 32 is located on a radial line 33 central between the arms 24. See FIG. 2, at A.

The displacing means 30 is fast with one bracket 26; the other bracket is furnished with actuating means 34 to move the rod 31 between its active and inactive positions when the brackets are swung to move their arms 24 relative to one another.

Preferably, and as shown, the arm with which the displacing means is associated is the trailing arm, having regard for the direction of movement of carrier 16. Affixed to bracket 26 of the trailing arm is a plate 35 to which a cranked pivot rod 36 is journalled. The push rod 31 is anchored to one end of the pivot rod 36. The cranked end 37 of pivot rod 36 depends below the plate 35 for engagement by a control pin 38 constituting the actuating means 34. The control pin 38 is fast with the bracket 26 of the leading arm. It will be observed that torsion spring means 39 is mounted on the pivot rod 36. The spring means 39 serves to raise the push rod to its active position.

In operation, while the arms 24 of carrier 16 are parallel or closed, the control pin 38 extends from bracket 26A in engagement with the cranked end 37 of pivot rod 36, and holds the rod 36 rotated to a position in which push rod 31 is lowered.

When the brackets 26A, B are swung in opposite directions about mounting 27 to open the arms 24, pin 38 moves counterclockwise (FIG. 2). Simultaneously, the cranked end 37 of pivot rod 36 moves in the opposite direction, due to movement of mounting plate 35 with the bracket 26B of the trailing arm. Thanks to the respective movements of pin 38 and cranked end 37, the pivot rod 36 is freed for rotation by the torsion spring 39 such as to raise the push rod 31 to its active position. The pivot rod 36 rotates counterclockwise in its journal, as viewed in FIG. 3. Upon moving the brackets 26 to restore the arms 24 to their parallel closed positions, the control pin 38 bears on the cranked end 37 and displaces it in a direction for lowering the push rod 31, at the same time loading the torsion spring 39. So long as the arms 24 remain closed, the push rod 31 is retained in its lowered, inactive position.

The displacing means 30 does not have to be of the form illustrated and described above, and different arrangements could be employed to raise and lower the hose displacing rods. Latching means can be provided to secure the rods in either of their positions. Actuating means to raise and lower the rods can be affixed to the hub 15 at locations appropriate for raising and lowering them where desired.

The provision of the transport apparatus comprising the carrier, rail(s) and displacing means 30 is particularly beneficial where a line closer L has two leg-separating support rails 18', 18'' and is linked to another processing machine T through a transfer mechanism TM. The presence of a transfer mechanism may mean, as in the illustrated embodiment, that sections of the rails beside the transfer mechanism TM are omitted and hence the rails do not rotate with the carousel 14. The displacing means ensures that lower portions of the blanks travel along the rails aligned with the associated carrier and at the same speed. Thus, the risk of the lower portions dropping off the rails is eliminated or very substantially minimised, and the lower portions are advanced so as to arrive in properly timed relationship with the carriers at the transfer mechanism. By this means, successful transfer can be attained.

The exact geometrical configuration of the displacing means 30 can be varied if desired or required by the machine or conveying system incorporating the displacing means 30. For example, where there are two rails 18', 18", the displacing means has been shown as a rod exhibiting two sections which, in the operative position, comprise a main upstanding section numbered 31*a* and a downwardly-extending end section numbered 32*a*. As shown at A in FIG. 1, these sections are positioned for engaging two hose lower portions, draped over the respective rails, along a line passing radially through mounting 27, i.e. at right angles to the path of movement. The displacing means may be arranged alternatively, to maintain a different alignment or positional relationship between the lower portions and the companion portions of hose mounted on the carriers 16. Thus, one, or the other, or both said sections may be either ahead of or behind the said line, considered with regard to the direction of movement of the hose. For instance, end section 32*a* may be disposed ahead of companion section 31*a*, considered in the direction of movement. Section 32*a* then leads section 31*a*. By this means, the hose lower portions are (a) kept separate during their movement along the rails and (b) delivered in a chosen timed relationship for transfer. Moreover, if section 32*a* leads, the displacing means 30 will provide a beneficial effect of positively separating the hose portions previously draped over the rails when the means 30 is moved into its operative or active position during opening movement of the arms 24.

As noted hereinbefore, the invention finds especial application in a hosiery line closer, but is not limited thereto. The transport apparatus can be employed in any garment conveying system having movable carriers and a guide rail or the like which together support a garment during its travel. Thus, the said apparatus is applicable, inter alia, to the transport of hose individually, rather than in pairs as described in detail hereinbefore.

It is to be understood that the form of the invention described above and illustrated in the drawings constitutes but one, preferred embodiment and that it is not intended to attempt to illustrate all possible forms of the invention. Further, the words used herein are words of description rather than limitation and various changes may be made without departing from the spirit or scope of the invention disclosed herein.

I claim:

1. Apparatus for transporting a garment such as hosiery along a path, comprising garment advancing means movable along the path, an elongated member spaced from but extending alongside the path, the advancing means and elongated member serving jointly as garment support means, and garment displacing means operable positively to advance along the said member that part of the garment supported thereby, said displacing means being operatively connected with the advancing means, to be moved beside the elongated member at a speed assuring that the said part of the garment is moved in unison and in a chosen alignment with that part of the garment supported by the advancing means.

2. Apparatus according to claim 1, wherein the garment displacing means is mounted on the advancing means to move therewith.

3. Apparatus according to claim 1, wherein the advancing means has a leading end and a trailing end, having regard to its direction of movement, and the displacing means is operatively disposed in a chosen alignment with the said ends for pushing said part of a garment along the elongated member.

4. Apparatus according to claim 1, wherein the displacing means is mounted for movement between an inactive and an active, garment-displacing position, and in its inactive position the displacing means is so disposed as to allow unobstructed access to the advancing means for engaging a garment therewith.

5. Apparatus according to claim 4, wherein the displacing means is mounted pivotably to move between the active and inactive positions, and is biassed towards one of the said positions.

6. Apparatus according to claim 4, wherein the path and elongated member are horizontally disposed and the displacing means comprises an arm movable between a raised, garment-displacing position beside the said member and a lowered, inactive position wherein said arm is spaced away from said elongated member.

7. Apparatus according to claim 4, wherein the advancing means has first and second garment holding elements mounted for relative movement whereby the holding elements are disposed either parallel, alongside one another or spread apart, and the garment displacing means is in its active, garment-displacing position when the holding elements are spread apart.

8. Apparatus according to claim 7, wherein the garment-displacing means is fast with one holding element and the other holding element includes means to move the garment displacing means between its active and inactive positions when the holding elements are moved relative to one another.

9. Apparatus for transporting a garment such as hosiery along a path, comprising garment advancing means movable along the path, an elongated member spaced from but extending alongside the path, the advancing means and elongated member serving jointly to support a garment with a limp part thereof draped over said member, the apparatus further including means to overcome a tendency for the limp part to slip off the said member and comprising garment displacing means operable positively to advance said limp part along the said member, said displacing means being movable in synchronism with the advancing means beside the elongated member, thereby assuring that the limp portion moves at the speed of and in a chosen alignment with that part of the garment supported by the advancing means.

10. A hosiery machine including apparatus according to claim 1, the machine having a rotary carousel mounting a plurality of hose carriers constituting said advancing means which move around a circular path, and the elongated member is at least one rail which encircles said carousel and the path swept by the carriers.

11. A machine according to claim 10, which comprises an automatic hose loader for a hosiery processing machine that performs a seaming operation on hosiery, said loader being operable (1) to convey hosiery from a receiving station to a transfer station adjacent said processing machine and (2) to transfer hosiery onto same.

12. A hosiery line closer comprising:

a seamer for joining pairs of hose to form pantihose garments;

a rotationally-mounted carousel;

a plurality of hose carriers mounted on said carousel for movement therewith around a closed path, to advance hose mounted thereon betwen hose loading, hose seaming and pantihose discharge stations;

at least one elongated member extending along at least part of said path, said at least one member being spaced from said carriers and coacting therewith to support hose being advanced with parts of said hose being draped over and slidable upon said at least one member;

means to overcome a tendency for the draped parts of said hose from slipping off said at least one member, said means comprising garment displacing means operable positively to advance said draped parts along at least a portion of the lengthwise extent of said at least one member, and said displacing means being driven along the said at least one member at a speed assuring that said draped parts move in unison and in a chosen alignment with parts of the hose supported by the advancing means.

13. A line closer according to claim 12, wherein each carrier has an associated displacing means mounted thereon for movement therewith.

14. A line closer according to claim 12, wherein said displacing means is movable between an inactive position and an active, garment-displacing position, and means is provided for moving the displacing means to said active position, the moving means being activated after a carrier has left said loading station.

15. A line closer according to claim 12, wherein said displacing means is located in a predetermined position ahead of said carrier having regard for the direction of movement of said carrier along said at least one member.

16. A line closer according to claim 14, wherein there are two elongated members each to support a respective one of a pair of hose mounted on a carrier, and said displacing means has two hose-engaging portions - one for each of the respective hose, said portions being disposed one ahead of the other so that upon moving the displacing means to said active position, one portion advances its associated hose ahead of the other hose, thereby separating the two hose, and the displacing means being configured to retain the hose separation while displacing them along said path in unison with the carrier.

17. A line closer according to claim 12, wherein said carrier has two relatively-movable, hose holding elements adapted to move from positions alongside one another at said loading station to positions spread apart in readiness to present two hose properly to said seamer for joining together, and said displacing means is moved to its active position in timed relationship with movement of said elements to their spread apart positions, thereby to prevent slippage of said draped parts off said at least one member while said elements are assuming their spread apart positions.

18. A line closer according to claim 12, combined at the unloading station with a toe closer and an automatic pantihose transfer mechanism, the toe closer having suction tubes each to receive an allotted one of two hose legs of joined together pantihose supported by said carrier, the transfer mechanism being operative (1) to strip a body portion of said joined together pantihose from said carrier, (2) to transport said body portion to said suction tubes and (3) to mount said body portion around said tubes, and said garment displacing means being operative to displace said draped parts to said unloading station for presentation to said tubes in properly timed relation to arrival of the carrier at said unloading station.

* * * * *